US005623838A

United States Patent [19]

Cuche

[11] Patent Number: 5,623,838

[45] Date of Patent: Apr. 29, 1997

[54] ADJUSTABLE LINK FOR CHAIN LINK BRACELET

[75] Inventor: Cyril Cuche, Bienne, Switzerland

[73] Assignee: SMH Management Services AG, Biel, Switzerland

[21] Appl. No.: 623,003

[22] Filed: Mar. 28, 1996

[30] Foreign Application Priority Data

Apr. 11, 1995 [FR] France ..... 95 04334

[51] Int. Cl.[6] ..... A44C 5/04

[52] U.S. Cl. ..... 63/5.1; 63/6; 63/9

[58] Field of Search ..... 63/3, 4, 5.1, 9, 63/6; 59/80, 82; 368/281, 282

[56] References Cited

FOREIGN PATENT DOCUMENTS 0345014 12/1989 European Pat. Off. .
0350785 1/1990 European Pat. Off. .
2058819 5/1971 France .
2852482 6/1980 Germany .
9011420 12/1991 Germany .
272897 4/1951 Switzerland .
669501 3/1989 Switzerland .

*Primary Examiner*—Kien T. Nguyen
*Attorney, Agent, or Firm*—Griffin, Butler Whisenhunt & Kurtossy

[57] ABSTRACT

An adjustable link (1) for a bracelet having a plurality of fixed links comprises a cap (6) into which a base (7) slides and a mechanism (8) with push-pieces (9, 10) which enables the length of the link to be extended to at least two different lengths so as to enable the length of the bracelet to be adapted to the variations in diameter of the wrist wearing it. The link may be incorporated in a bracelet carrying a watch.

4 Claims, 3 Drawing Sheets

ADJUSTABLE LINK FOR CHAIN LINK BRACELET

FIELD OF THE INVENTION

The invention relates to an adjustable link intended to be incorporated in a bracelet consisting of a plurality of links.

BACKGROUND OF THE INVENTION

It is known that the human wrist varies in diameter as a function of the ambient temperature. During the warm season its diameter increases, while during the cool season this diameter decreases. A bracelet encircling the wrist must therefore be able to be adjusted as a function of these differences in diameter if one wishes, in the circumstances mentioned above, to prevent the bracelet hanging from or pinching the wrist.

Wristlets made of leather may have a sufficient number of holes to facilitate this adjustment. Indeed, one chooses the appropriate hole to be received by the tongue of the buckle in order to fit the wristlet correctly. On the other hand, if one is dealing with a bracelet formed of articulated links, this choice is no longer possible and one has to be satisfied with a length adjustment which is made once and for all when the bracelet is purchased. Further, at the time of this purchase, one is limited to an adjustment which is no more precise than that of the length of a link. In order to overcome this disadvantage and in the event that the chain link bracelet comprises for example a folding type clasp, a solution to this problem has already been proposed, a solution is explained for example in patent application EP-A-0 350 785.

In this document, the clasp comprises a first element carrying a hook and a second element under which is arranged a spring catch attached to a push-piece. The second element is provided with an opening which reveals two identical holes arranged side by side in the longitudinal direction of the bracelet. The hook may be locked as required into the first or the second hole according to whether one wishes the bracelet to be tightly or more loosely wound around the wrist. In a closed position the catch of the hook is placed under the spring catch. In order to open the clasp, one presses the push-piece. This device enables the length of the bracelet to be lengthened or shortened by an amount shorter than the length of a link.

Other clasps are provided with systems producing the same effect. For example, patent applications CH-A-669 501, DE-A-2 852 482 and FR-A-2 058 819 all use a system provided with sliding racks and clicks.

Thus all the proposed fine adjustment systems known to the applicant are connected to a clasp which is sometimes complicated to manufacture. In order to overcome these disadvantages, the invention proposes an adjustable link which is independent from the clasp.

SUMMARY OF THE INVENTION

An object of the present invention is to provide a link for a bracelet, the link being characterised in that it includes means for manually adjusted the link to at least two different lengths to enable the bracelet length to be adapted to the variations in diameter of the wrist wearing it, said adjustable link comprising two attachment means for connecting it to the other links or elements forming part of the bracelet.

The link of the invention may thus be placed anywhere in the chain link bracelet either close to the clasp or next to a watch case if the bracelet comprises a watch. It has the advantage of being short in length and thus inconspicuous and compact. Its appeal also lies in that it can be proposed as an accessory, sold separately by the retail jeweler and easily able to be inserted when it is required in the bracelet.

BRIEF DESCRIPTION OF THE DRAWINGS

The invention will now be explained in the description which follows with the aid of the drawings which illustrate an embodiment taken by way of example, and in which.

DESCRIPTION OF PREFERRED EMBODIMENT

Figure 1:
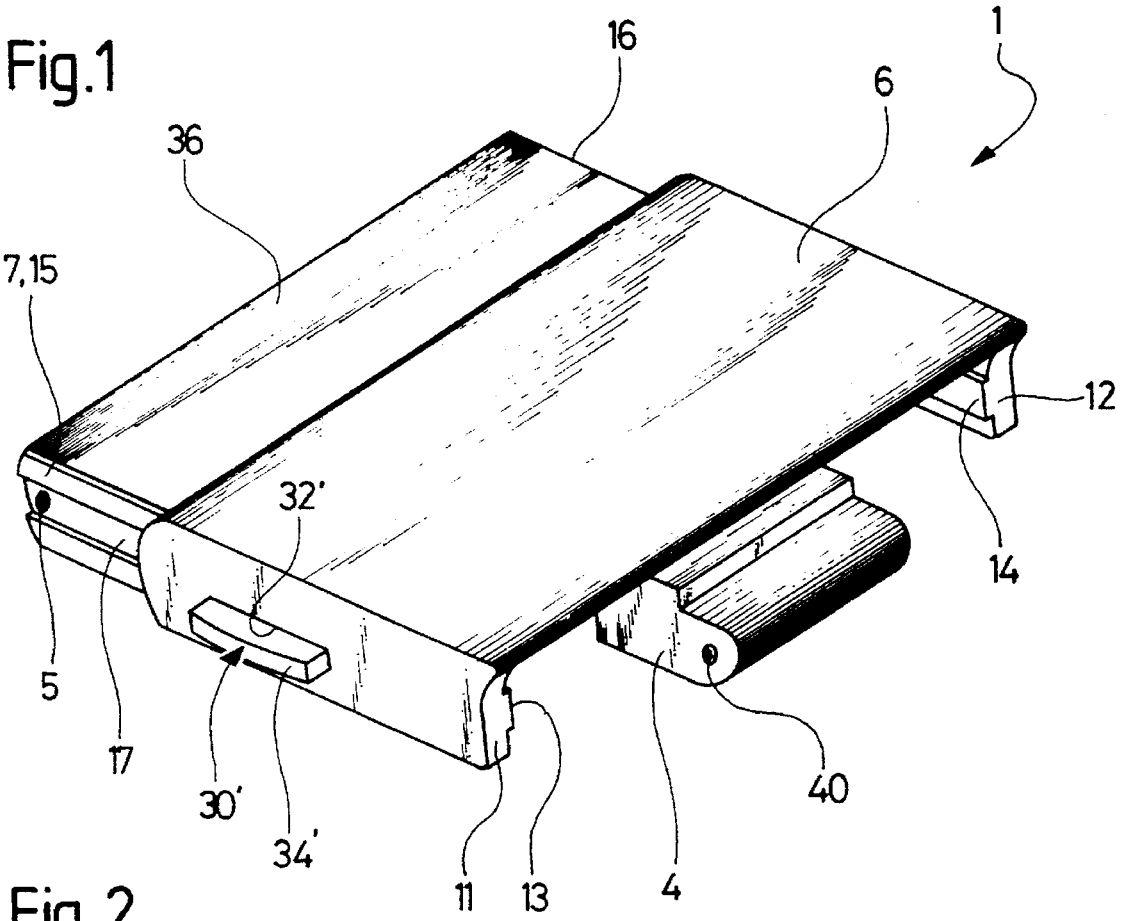
FIG. 1 is a perspective view of the link of the invention shown in an extended position.
Figure 2:
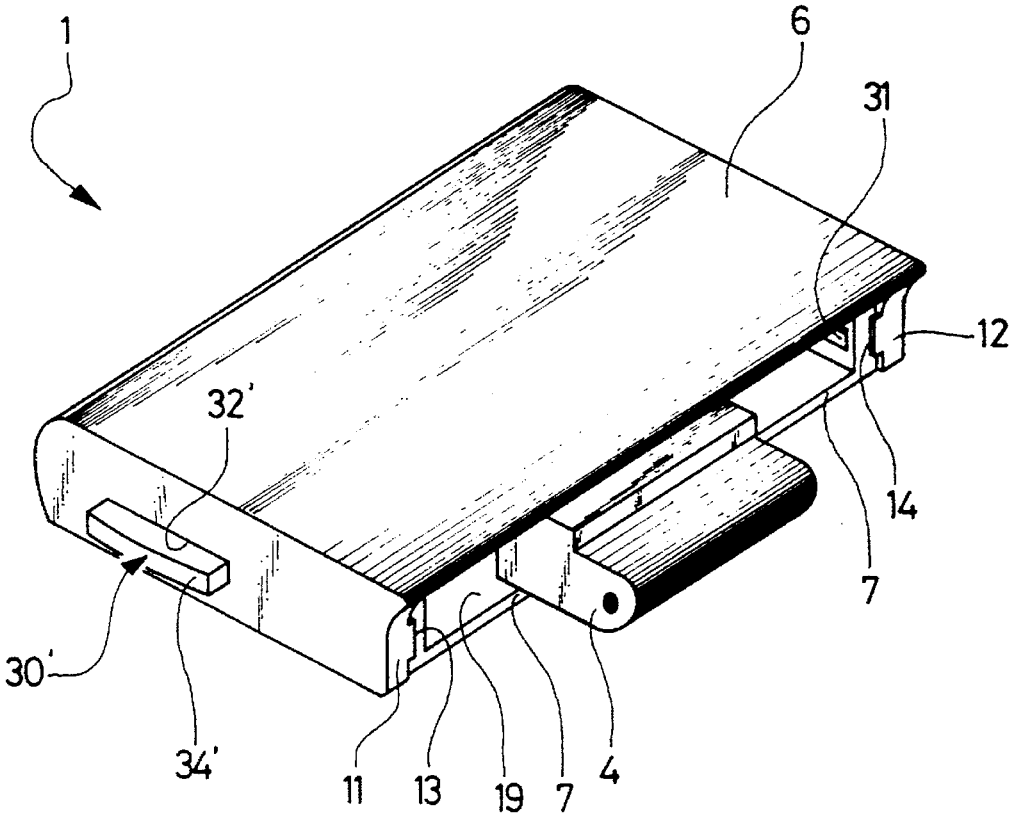
FIG. 2 is a perspective view of the link of the invention shown in a retracted position.

Perspective views of the link according to the invention are shown in FIGS. 1 and 2. FIG. 1 shows link 1 in an open or extended position, while FIG. 2 shows this same link 1 in a closed or retracted position. This adjustable link is intended to be incorporated in a bracelet comprising a plurality of links. It is provided with means which will be described in detail below, for altering its length in the longitudinal direction of the bracelet via a manual action, to arrange it to at least two lengths, one open and the other closed. It is thus possible to adapt the length of the bracelet to the wrist wearing it. FIG. 1 also shows that adjustable link 1 is provided with means 4 and 5 for connecting it to the other links or other elements, for example a clasp or watch case, forming part of the bracelet.

More specifically, and according to the embodiment which will be described, by way of example, in the description which follows, link 1 comprises three essential parts which are shown clearly in FIG. 3, where one of these parts is cut away to facilitate the following explanations.

Adjustable link 1 comprises first of all a cap 6 to which are fixed first attachment means 4 which enable the link to be connected to another fixed link of the bracelet. Means 4 shown in entirety in FIGS. 1 and 2 and partially in FIG. 3, comprise a small hinge fixed to the cap and pierced with a hole 40 intended to receive a small bar 41 for connecting it to a fixed link 2 (see FIG. 5). Adjustable link 1 comprises next a base 7 to which are fixed second attachment means 5 which enable it to be connected to another fixed link of the bracelet. These means 5 shown in FIGS. 1 and 3, comprise a small bar passing through both base 7 and a hinge 50 which forms part of a fixed link 3 (see FIG. 5). As is seen clearly in FIGS. 1 to 3, base 7 is capable of sliding into cap 6. Adjustable link 1 comprises finally a mechanism 8 with push-pieces 9 and 10, said mechanism being illustrated alone in FIG. 4. Push-pieces 9 and 10 of mechanism 8 can be actuated manually and enable one of the at least two lengths which can be offered by adjustable link 1 to be selected.

Each of the parts forming the adjustable link and its operating method will now be described in detail. In order to do so, reference will be made to FIGS. 1 to 4 mentioned above and also to FIG. 5 which is a plane cut away view of adjustable link 1, this link being incorporated between two other links 2 and 3 forming part of the bracelet.

Cap 6 has the shape of a U formed of short branches 11 and 12. The inside of each of these branches comprises a rail respectively referenced 13 and 14. The face joining the two branches is of a rectangular shape whose dimensions may match those of the other links forming the bracelet. Base 7 is tube-shaped with a rectangular cross-section. External faces 15, 16 of the small sides of this tube each carry a groove 17, 18 sized so as to slide on a rail 13, 14 of cap 6. On of the large sides of the tube has a closed face 19, while the other large side is provided with racks 21 and 22 which face each other, these racks being directed in the longitudinal direction of the bracelet. Each of racks 21 and 22 is provided with at least two teeth referenced respectively 23', 24' and 23, 24. Push-piece mechanism 8, shown clearly in FIG. 4, comprises a profile bar 25, also U-shaped, capable of moving freely inside the tube of base 7. The internal faces of the branches of the U of the profile bar comprise grooves 26 which act as guides for two push-pieces 9 and 10, each of which are provided with a rail 27 sliding into groove 26. Push-pieces 9 and 10 are arranged facing each other as they extend and are separated by a return spring 28. Each of push-pieces 9 and 10 also comprises a notch 29 and 29' capable of cooperating with one of teeth 23 or 24 and 23' or 24' of one of racks 22 and 21. Each of push-pieces 9 and 10 further comprises a head referenced respectively 30 and 30', onto which the manual pressure is applied. Head 30 emerges on the one hand from small side 16 of base 7 via an opening 31 whose length is greater than that of the head and on the other hand from branch 12 of cap 6 via an opening 32 whose dimensions are substantially equal to the dimensions of the cross-section of the head. Likewise, head 30' emerges on the one hand from small side 15 of base 7 via an opening 31' whose length is greater than that of the head and, on the other hand, from branch 11 of cap 6 via an opening 32' whose dimensions are substantially equal to the dimensions of the cross-section of the head.

From the preceding description, it will have been understood that by applying pressure onto each of heads 30 and 30', one releases notches 29 and 29', from one of the teeth of racks 22 and 21. Base 7 can then move freely in relation to cap 8 until the notch of each of the push-pieces falls into another tooth of each of the racks. It will be noted that in order to lengthen the link, pressure must be applied to the push-piece heads, while in order to shorten it, the base needs only to be pushed into the cap, for example by squeezing the bracelet with the hand. It will be understood that this is due to the serrated teeth shape of the rack teeth, said teeth being directed in the direction required to obtain the effect cited. Thus, when traction is applied to the bracelet, which happens constantly, this bracelet will not be able to increase in diameter unless one deliberately applies pressure to the push-pieces. In the event of shortening, the compression effort applied to the link causes the push-piece notch to move up along the inclined plane of the tooth to cause it eventually to fall into the recess of the following tooth, without it being necessary to act upon the push-piece heads. Whatever happens, it will be noted that push-piece mechanism 8 follows the movement of cap 6, whereas it slides into base 7 when a change in length is carried out.

It should be noted that the embodiment shown in the drawings uses racks each possessing three teeth, which enables the adjustable link to be placed in three different positions to extend further the scope of adjustment. For this purpose, and in relation to the above description, an additional tooth 35 and 35' has been added to each of racks 22 and 21. By way of information, it should be noted that a step of 3 mm has been selected between each tooth.

In order to conceal racks 21 and 22, and push-piece mechanism 8, FIG. 1 shows that a screen 36 has been placed on base 7.

Figure 3:
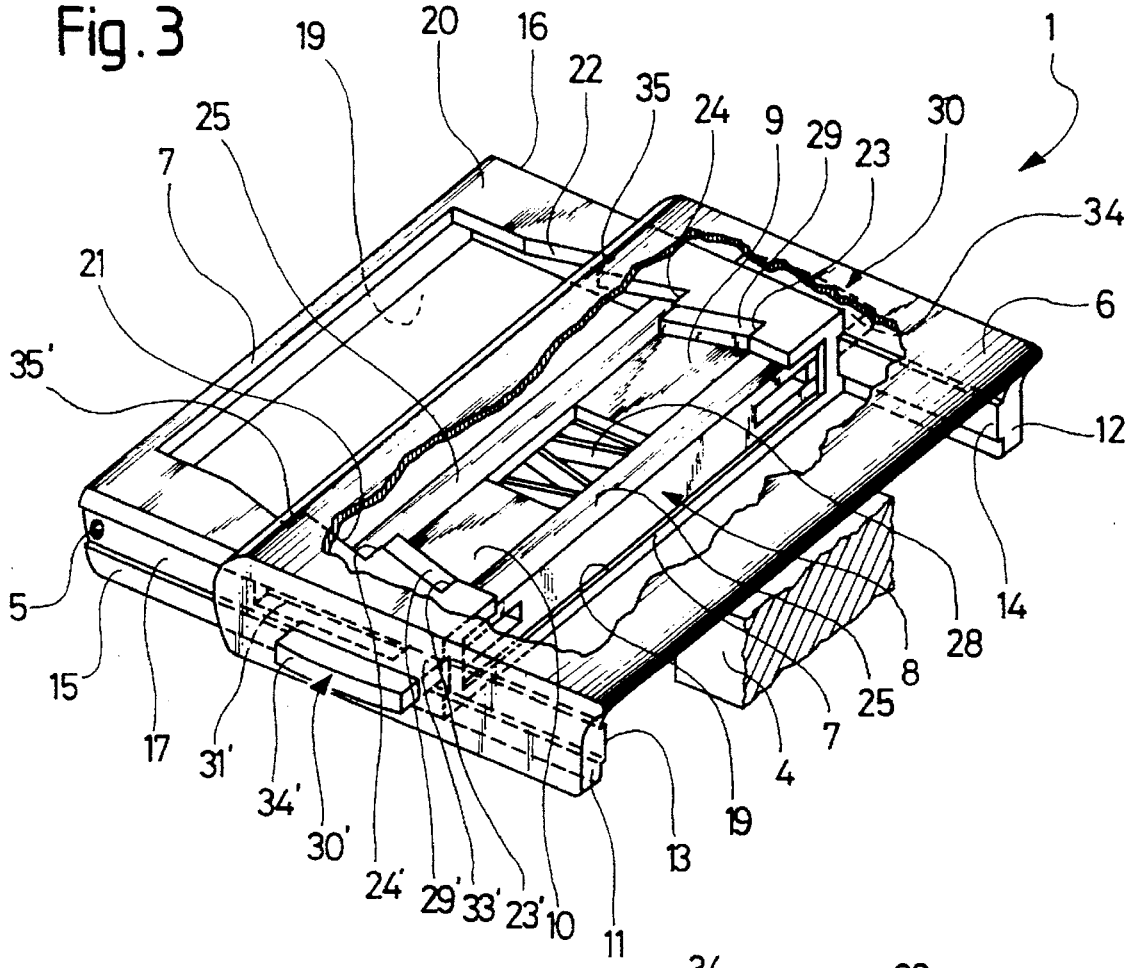
FIG. 3 is a perspective cut away view of the link of the invention in an extended position.
Figure 4:
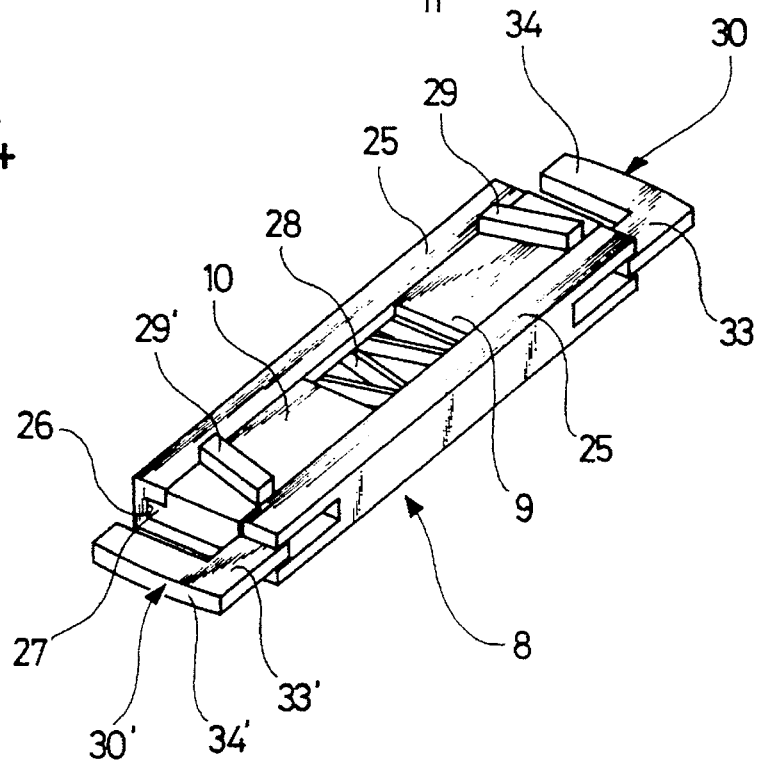
FIG. 4 is a perspective view of the push-piece mechanism alone which forms part of the link shown in FIG. 3.
Figure 5:
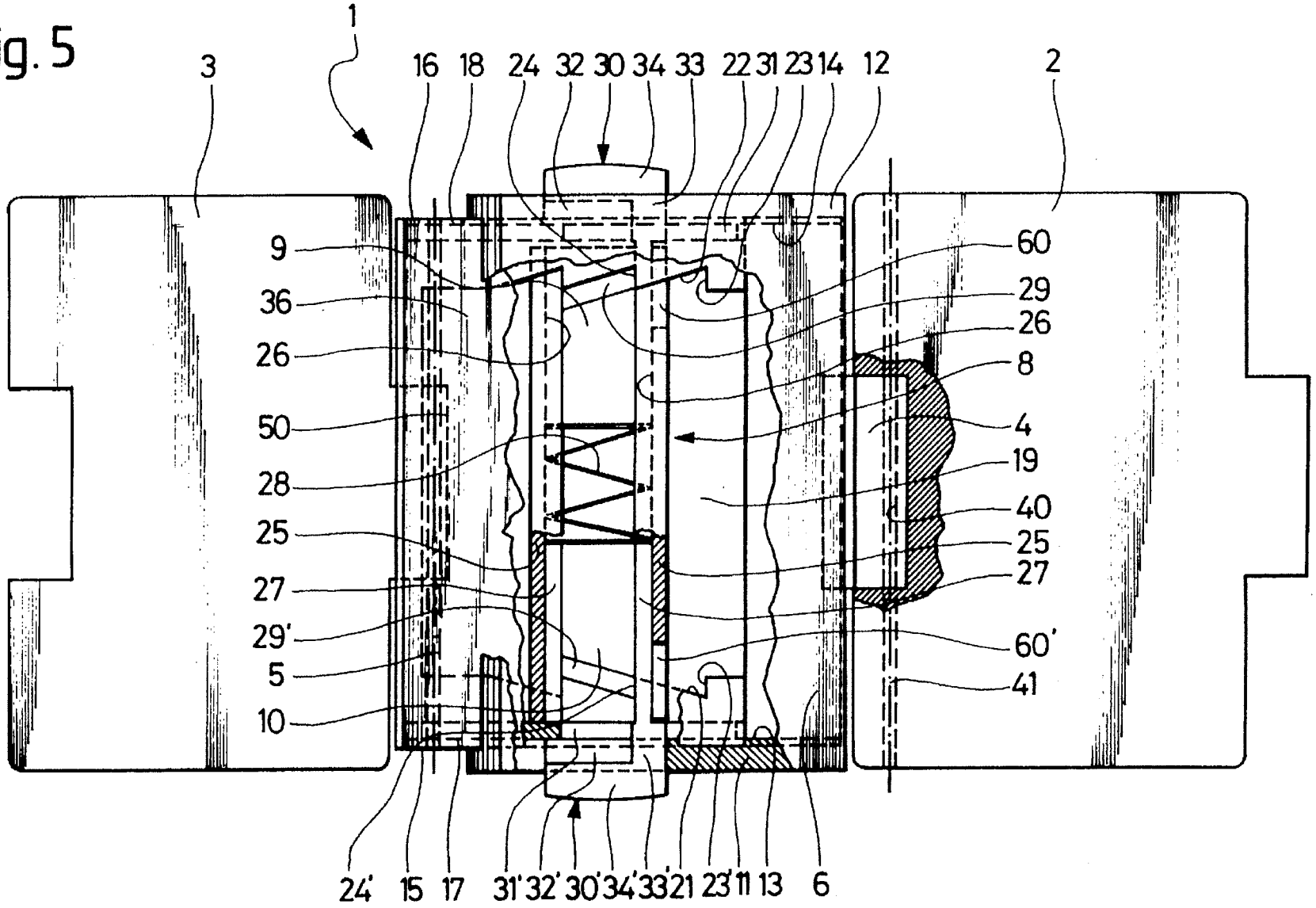
FIG. 5 is a plane cut away view of the link of the invention, this link being incorporated between two other links forming part of the bracelet.

As is shown in FIGS. 3, 4 and 5, head 30, 30' of each of push-pieces 9, 10 is in the shape of a cross with a rectangular cross-section. The vertical part 33, 33' of the cross, which moves into the opening 31, 31' made in small side 16, 15 of base 7, has a width substantially smaller than the horizontal part 34, 34' of said cross, this horizontal part being adapted to opening 32, 32' of branch 12, 11 of cap 6. It will be understood that this manner of making the push-piece head enables the length of openings 31, 31' made in base 7 to be significantly reduced, and consequently the length of the link itself to be reduced.

FIG. 5 also shows that in order to improve the finger hold on horizontal part 34, 34' of the head, the length of said horizontal part has been increased on the right of the drawing, which has required the provision of grooves 60, 60' in profile bar 25. These grooves avoid enlarging the profile bar and thus the link itself.

The description which has just been made of the adjustable link also shows that it is easy to assembly and dismantle, since it does not include any screws which would necessitate the use of a tool. Indeed, push-piece mechanism 8 can be assembled simply and immediately. Once this assembly has been achieved, it is pushed into base 7 by compressing the push-pieces until heads 30, 30' emerge from openings 31, 31'. Cap 6 is then slid onto the base by applying the same pressure to heads 30, 30' until they emerge from openings 32, 32'.

What is claimed is:

1. An adjustable link for a bracelet having a plurality of links extending in a longitudinal direction, said adjustable link comprising:

first and second attachment means for connecting said adjustable link to links of a bracelet;

said first attachment means being fixed to a cap and said second attachment means being fixed to a base slidable in said cap to vary the length of said adjustable link in said longitudinal direction; and, a push-piece mechanism comprising two manually actuated push-pieces for selecting one of at least two different length values of said adjustable link to thereby adjust the length of the bracelet to variations in diameter of a wrist of a user, said cap being in the shape of a U with branches, each branch having thereon a cap rail turned towards the inside of the U, said base being tube-shaped with a rectangular cross-section, said base having small sides with external faces each carrying a groove sized so as to slide on one of the cap rails, said base having large sides with external faces, the face of one of the large sides being closed and the face of another large side having racks thereon which face each other and are directed in the longitudinal direction of the bracelet, each of said racks having at least two teeth, said push-piece mechanism comprising a return spring; and a U-shaped profile bar movable in said base and having branches with guide grooves on internal faces of the branches, said push-pieces having rails thereon which are guided in said guide grooves, said push-pieces being arranged facing each other and separated by said return spring, each of said push-pieces further comprising a notch cooperating with one of the teeth of one of the racks and a head to which manual pressure may be applied, each head extending through one of the small sides of the base via an opening having a length greater than that of the head, and through one of the branches of the cap via an opening having dimensions substantially equal to the dimensions of the cross-section of the head.

2. An adjustable link according to claim 1, wherein the head of each of the push-pieces has the shape of a cross with a rectangular cross-section, a vertical part of the cross being movable in an opening in a small side of the base, the vertical part having a width substantially smaller than the width of a horizontal part which is adapted to an opening of a branch of the cap.

3. An adjustable link according to claim 1, wherein each of said racks is provided with three teeth.

4. An adjustable link according to claim 1, wherein the face of the base having racks is covered with a screen to cover the push-piece mechanism.

* * * * *